US005809799A

United States Patent [19]

Jeon

[11] Patent Number: 5,809,799

[45] Date of Patent: Sep. 22, 1998

[54] REFRIGERATOR HAVING A DEVICE FOR GENERATING AN AIR CURTAIN

[75] Inventor: Yong-Deok Jeon, Incheon, Rep. of Korea

[73] Assignee: Daewoo Electronics Co., Ltd., Seoul, Rep. of Korea

[21] Appl. No.: 870,441

[22] Filed: Jun. 6, 1997

[51] Int. Cl.[6] ..... F25D 17/04

[52] U.S. Cl. ..... 62/408; 62/256; 454/193

[58] Field of Search ..... 62/256, 255, 408; 454/188, 189, 191, 193

[56] References Cited

U.S. PATENT DOCUMENTS 2,775,187 12/1956 McClurkin ..... 62/256
4,058,989 11/1977 Horvay et al. ..... 62/256
4,379,391 4/1983 Rhee ..... 62/256
4,478,047 10/1984 Ibrahim ..... 62/256
4,962,649 10/1990 Battocletti ..... 62/256

*Primary Examiner*—William E. Tapolcai
*Attorney, Agent, or Firm*—Beveridge, DeGrandi, Weilacher & Young LLP

[57] ABSTRACT

A refrigerator has a device for generating an air curtain for shutting off an opening of a cooling compartment, and plates are disposed at a cool air discharge port of the air curtain generating device. The plates control the discharging direction of the cool air according to the opening and closing of a door. When the door is opened, the air curtain for preventing the leakage of cool air is generated by the plates. When the door is closed, the cool air is supplied at the area adjacent to the door and the inner spaces of the pockets formed at the door. Thus the foodstuffs in the cooling compartment are rapidly and uniformly cooled.

2 Claims, 3 Drawing Sheets

REFRIGERATOR HAVING A DEVICE FOR GENERATING AN AIR CURTAIN

BACKGROUND OF THE INVENTION

1. Field of the Invention

The present invention relates to a refrigerator having a device for generating an air curtain, and more particularly to a refrigerator in which cool air is supplied into pockets formed at an inner side surface of a door by the air curtain generating device when the door is closed.

2. Prior Art

FIG. 1 shows a conventional refrigerator, which shows a refrigerator having a device for generating an air curtain for shutting off the opening of a cooling compartment when the door is opened. The refrigerator has, as shown in FIG. 1, a cabinet 10 forming a freezing compartment 21 and a fresh food compartment 22 which are partitioned from each other by a wall 27, and a freezing compartment door 24 and a fresh food compartment door 25 which open/close the freezing compartment 21 and fresh food compartment 22 respectively.

A compressor 23 is installed in a lower rear part of the cabinet 10, and an evaporator 29 for generating cool air by evaporating refrigerant supplied from the compressor 23 is installed in the rear of the freezing compartment 21. A cooling fan 19 for blowing the cool air generated by the evaporator 29 is installed at the upper side of the evaporator 29.

A device 20 for generating an air curtain is provided in the upper side of the fresh food compartment 22. The air curtain generating device 20 comprises a cool air duct 13 provided in the upper side of the fresh food compartment 22, and a blowing fan 11 for blowing the cool air from the evaporator 29 into the cool air duct 13. The cool air duct 13 is formed with a cool air discharge port 15 at one end thereof which is opened downward at the area adjacent to an opening of the fresh food compartment 22. The cool air blown into the cool air duct 13 is discharged downward, by which the air curtain for shutting off the opening of the fresh food compartment 22 is generated.

In the fresh food compartment 22, a sensor (not shown) for sensing the opening/closing of the fresh food compartment door 25 is provided, and the blowing fan 11 is controlled to operate only when the open state of the door 25 is sensed by the sensor. Thus, the air curtain is generated only when the door 25 is open so as to prevent leakage of the cool air through the opening of the fresh food compartment 22 at the open state of the door 25.

A plurality of cool air ports 16, 18 are formed at the rear walls of the freezing compartment 21 and the fresh food compartment 22. When the door 25 is closed, the cool air from the evaporator 29 is blown by the cooling fan 19 to be supplied into the freezing compartment 21 and the fresh food compartment 22, and accordingly the foodstuffs stored in the freezing compartment 21 and the fresh food compartment 22 are frozen and refrigerated respectively.

However, in such a conventional refrigerator, there is a problem that the area adjacent to the door 25 cannot be cooled efficiently. The area adjacent to the door 25 lies in direct contact with the outside air when the door 25 is opened, and thus the temperature thereof rises to the temperature of the outside air in a short time. But, in such a conventional refrigerator, since the area adjacent to the door 25, especially the inner space of the pocket formed at the inner side surface of the door 25, cannot be cooled directly, rapid and uniform cooling cannot be achieved.

SUMMARY OF THE INVENTION

The present invention has been proposed to overcome the above described problems in the prior art, and accordingly it is an object of the present invention to provide a refrigerator in which the area adjacent to the door and the inner space of the pockets formed at the door can be cooled rapidly, and thus the cool air can be uniformly distributed in the cooling compartment.

To achieve the above object, the present invention provides a refrigerator having a cabinet forming a cooling compartment, a door mounted on said cabinet for opening/closing an opening of said cooling compartment, said door being formed with pockets for accommodating foodstuffs at an inner side surface thereof, and an evaporator for generating cool air, said refrigerator comprising: a cool air duct having a cool air suction port opened at an area adjacent to said evaporator and a cool air discharge port opened at an area adjacent to the opening of said cooling compartment; a fan for blowing air in said cool air duct, by which the cool air from said evaporator is discharged through the cool air discharge port; plates disposed at an area adjacent to the cool air discharge port, said plates for controlling a discharging direction of the cool air discharged through the cool air discharge port; a means for sensing opening/closing of said door; and a means for controlling said plates according to sensing results of said sensing means, whereby an air curtain for shutting off the opening of said cabinet is generated when said door is opened, and the cool air is supplied into the pockets by said plates when said door is closed.

Here, it is preferable that said controlling means comprises, a push button switch installed on said cabinet for being pushed and released by said door when the door is closed and opened respectively, by which an angular position varies; and a spring member for elastically supporting said push button switch.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the drawings.

Figure 1:
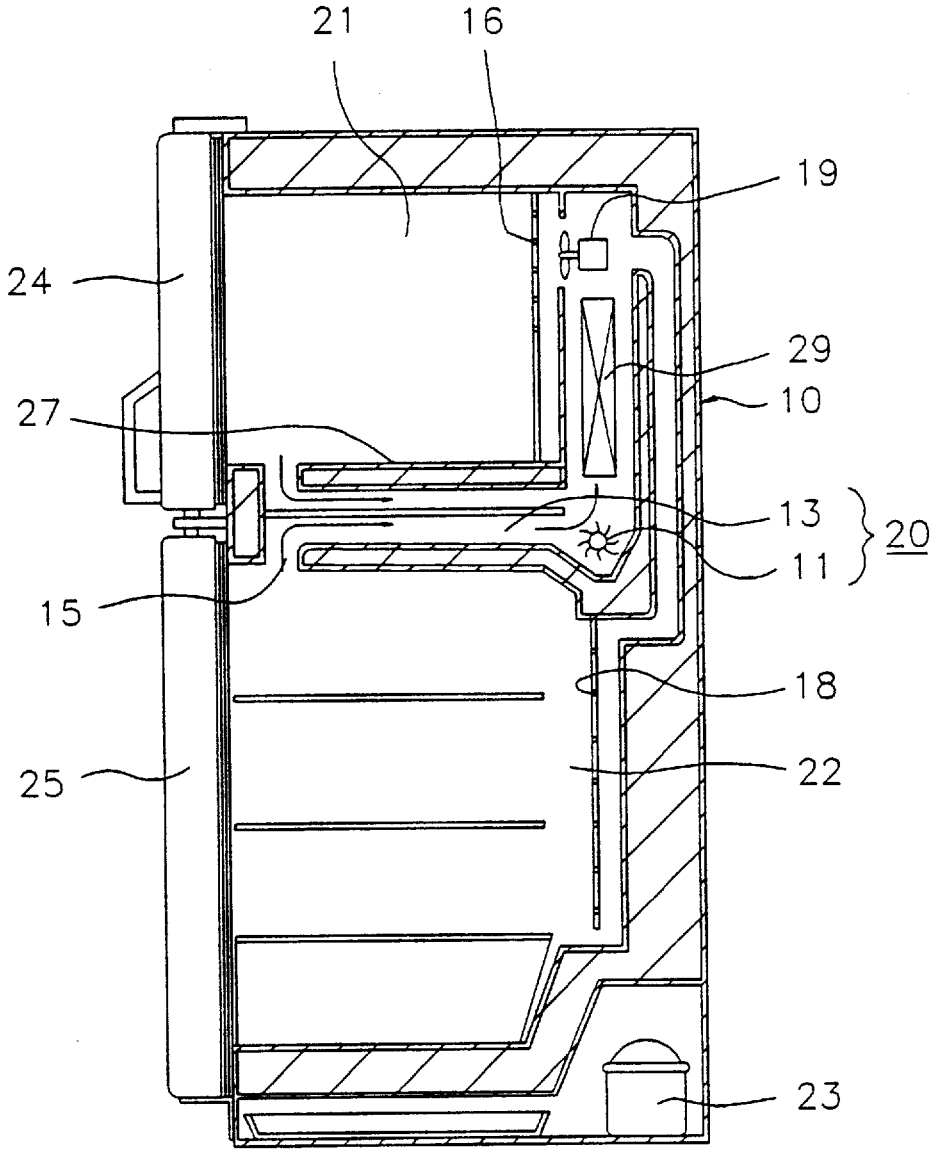
FIG. 1 PRIOR ART
FIG. 1 is a side sectional view of a conventional refrigerator having air curtain generating device.
Figure 2:
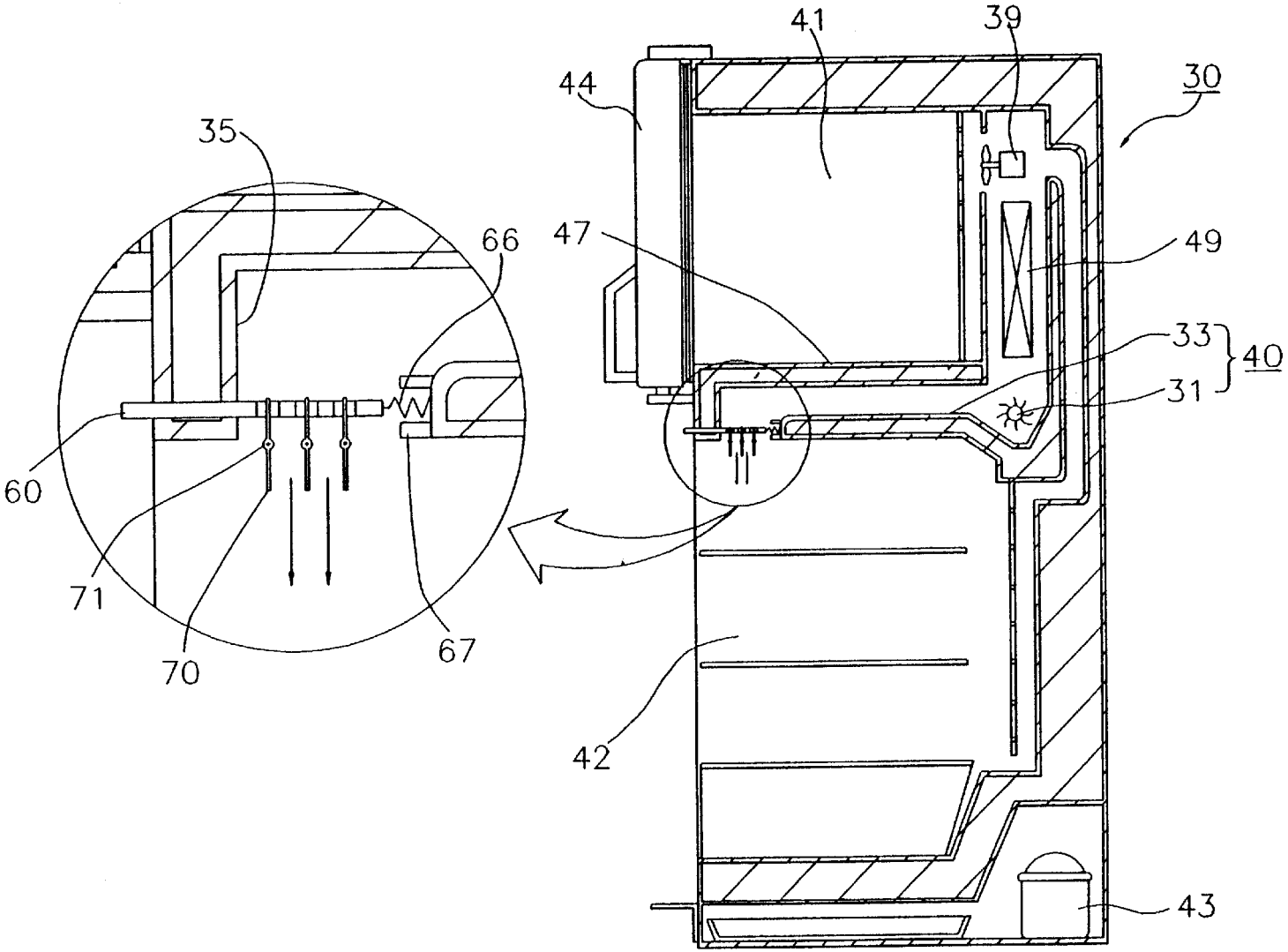
FIGS. 2 and 3 are side sectional views of a refrigerator according to the present invention.
Figure 3:
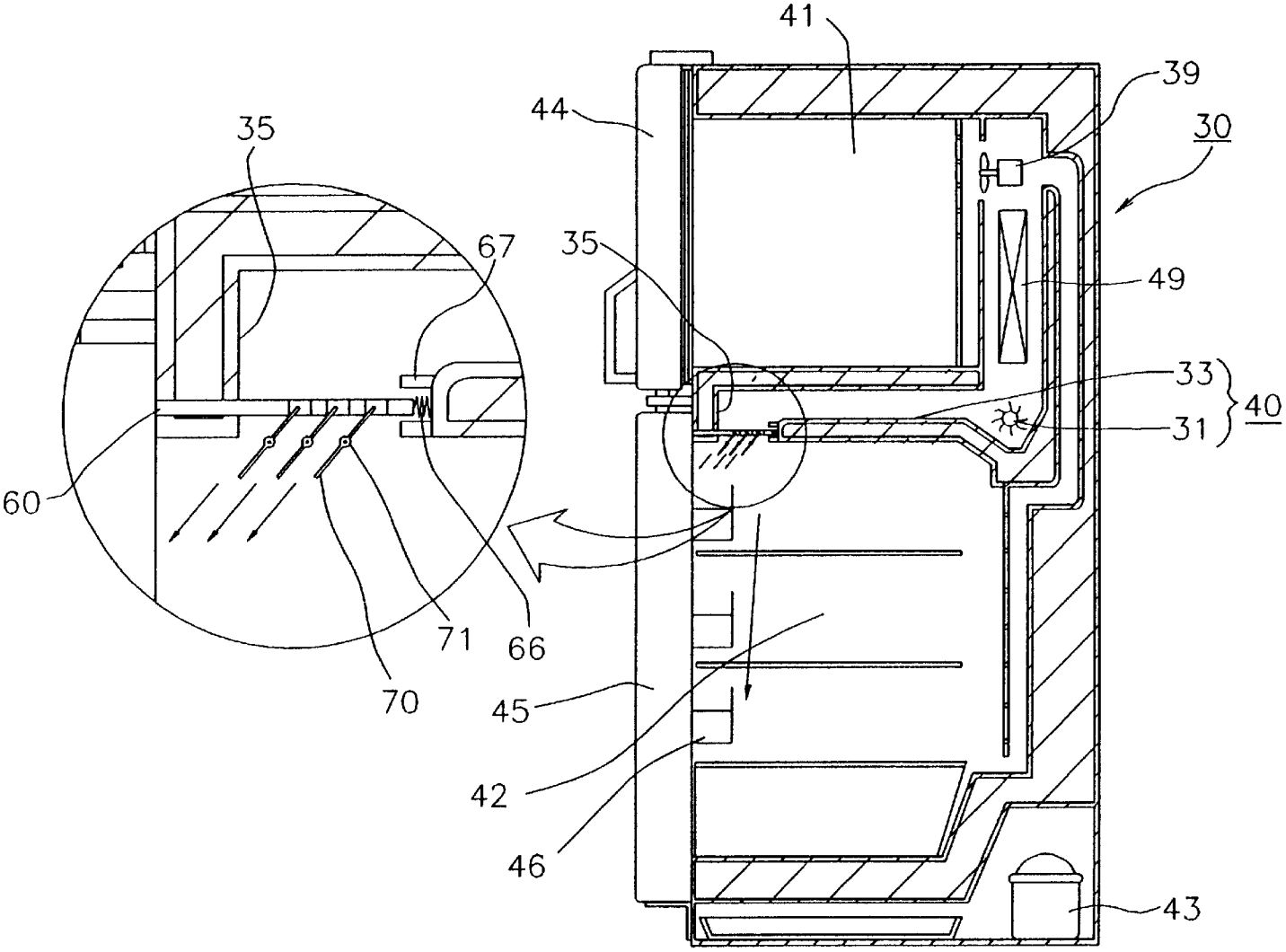

FIGS. 2 and 3 are side sectional views of a refrigerator according to the present invention, in which FIG. 2 shows the opened state of the door, and FIG. 3 shows the closed state of the door. The refrigerator according to the present invention has, like the conventional refrigerator shown in FIG. 1, a cabinet 30 forming a freezing compartment 41 and a fresh food compartment 42 which are partitioned from each other by a wall 47, and a freezing compartment door 44 and a fresh food compartment door 45 which open/close the freezing compartment 41 and fresh food compartment 42 respectively. At the inner side surface of the fresh food compartment door 45, a plurality of pockets 46 for accommodating the foodstuffs air formed.

A compressor 43 is installed in a lower rear part of the cabinet 30, and an evaporator 49 for generating cool air by evaporating refrigerant supplied from the compressor 43 is installed in the rear of the freezing compartment 41. At the upper side of the evaporator 49, a cooling fan 39 for blowing the cool air generated by the evaporator 49 is installed to supply the freezing compartment 41 and the fresh food compartment 42 with the cool air.

A device 40 for generating an air curtain which shuts off the opening of the fresh food compartment 42 according to the opening of the fresh food compartment door 45 is provided in the upper side of the fresh food compartment 42. The air curtain generating device 40 comprises a cool air duct 33 provided in the upper side of the fresh food compartment 42 and a blowing fan 31 for blowing the cool air from the evaporator 49 into the cool air duct 33. The cool air duct 33 is formed with a cool air discharge port 35 at one end thereof which is opened downward at the area adjacent to the opening of the fresh food compartment 42. The cool air blown into the cool air duct 33 is discharged downward, by which the air curtain for shutting off the opening of the fresh food compartment 42 is generated. For the blowing fan 31, a cross flow fan which is capable of blowing uniformly is adopted.

At an area adjacent to the cool air discharge port 35 in the wall 47, a plurality of plates 70 are disposed. The plates 70 are pivotably installed on the shaft 71 which is in the central part thereof, and control the discharging direction of the cool air discharged through the cool air discharge port 35.

A push button switch 60 is installed on the front surface of the fresh food compartment 42. The push button switch 60 is elastically supported by a spring member 66 to protrude at the front surface of the cabinet 30, and the spring member 66 is supported by a bracket 67. The push button switch 60 is pushed by the door 45 when the door 45 is closed and released when the door 45 is opened. The push button switch 60 is extended into the wall 47 to be connected with the upper end parts of the plates 70. When the push button switch 60 is released, the plates 70 are maintained in an upright state as shown in FIG. 2, so the discharged cool air moves straight down to generate the air curtain shutting off the frontal opening of the fresh food compartment 42. When the push button switch 60 is pushed, the plates 70 pivot so that the upper end part thereof is moved right a little to be tilted at a predetermined angle, so the discharged air is directed toward the inner surface of the fresh food compartment door 45 by the plates 70. Accordingly, the area adjacent to the fresh food compartment door 45 and the inner spaces of the pockets 46 are supplied with the cool air, and the cooling intensity of the fresh food compartment is uniformly maintained.

As described above, according to the present invention, the leakage of cool air when the door is opened is prevented by the air curtain, and the area adjacent to the door and the inner spaces of the pockets formed at the door are supplied with the cool air when the door is closed, by which the foodstuffs in the fresh food compartment are rapidly and uniformly cooled.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator having a cabinet forming a cooling compartment, a door mounted on said cabinet for opening/closing an opening of said cooling compartment, said door being formed with pockets for accommodating foodstuffs at an inner side surface thereof, and an evaporator for generating cool air, said refrigerator comprising:

a cool air duct having a cool air suction port opened at an area adjacent to said evaporator and a cool air discharge port opened at an area adjacent to the opening of said cooling compartment;

a fan for blowing air in said cool air duct, by which the cool air from said evaporator is discharged through the cool air discharge port;

plates disposed at an area adjacent to the cool air discharge port, said plates for controlling a discharging direction of the cool air discharged through the cool air discharge port;

a means for sensing opening/closing of said door; and a means for controlling said plates according to sensing results of said sensing means, whereby an air curtain for shutting off the opening of said cabinet is generated when said door is opened, and the cool air is supplied into the pockets by said plates when said door is closed.

2. The refrigerator as claimed in claim 1, wherein said controlling means comprises, a push button switch installed on said cabinet for being pushed and released by said door when the door is closed and opened respectively, by which an angular position varies; and a spring member for elastically supporting said push button switch.

* * * * *